United States Patent [19]

Yamamoto et al.

[11] Patent Number: 4,499,837

[45] Date of Patent: Feb. 19, 1985

[54] STITCH PATTERN SELECTOR IN SEWING MACHINES

[75] Inventors: Kimihiko Yamamoto, Nagoya; Hitoshi Ishikawa, Nishio, both of Japan

[73] Assignee: Aisin Seiki Kabushiki Kaisha, Kariya, Japan

[21] Appl. No.: 496,683

[22] Filed: May 20, 1983

[30] Foreign Application Priority Data

May 20, 1982 [JP] Japan ..... 57-085223

[51] Int. Cl.[3] ..... D05B 3/02

[52] U.S. Cl. ..... 112/158 A; 112/158 D

[58] Field of Search ..... 112/158 A, 158 D, 158 B, 112/158 C, 158 R

[56] References Cited

U.S. PATENT DOCUMENTS

| | | | |
|---|---|---|---|
| 3,208,417 | 9/1965 | Eguchi et al. | 112/158 |
| 3,229,655 | 1/1966 | Eguchi | 112/158 |
| 3,254,618 | 6/1966 | Eguchi | 112/158 |
| 4,297,956 | 11/1981 | Meier | 112/158 A |
| 4,408,553 | 10/1983 | Mihovch et al. | 112/158 A |

*Primary Examiner*—Peter Nerbun

*Attorney, Agent, or Firm*—Sughrue, Mion, Zinn, Macpeak, and Seas

[57] ABSTRACT

A stitch pattern selector is provided having pattern selector buttons that can be depressed with low force application.

5 Claims, 6 Drawing Figures

STITCH PATTERN SELECTOR IN SEWING MACHINES

BACKGROUND OF THE INVENTION

1. Field of the Invention

The present invention relates to a stitch pattern selector in a sewing machine.

2. Description of the Prior Art

U.S. Pat. No. 3,279,402 discloses a stitch pattern selector in a sewing machine. As shown in FIG. 3 of this patent, when the button 4 is depressed, the dependent leg 10 with the pawl 13 pivotably mounted thereon is slightly turned clockwise to bring the engaging projections 13*a*, 13*b* into abutment against the surface of the cam 3 and the plate 18 opeatively connected to the needle-bar assembly. To keep these engaging projections in abutting engagement with the cam 3 and the plate 18, the button 4 is further depressed to cause the angular edge 10*a* of the dependent leg 10 to engage the upper surface of the locking bar 13.

The plate 18 is normally urged by a spring (not shown) in a direction toward the engaging projection 13*b* of the pawl 13. When the button 4 is to be depressed while the plate 18 is held in engagement with the engaging projection 13*b* of the pawl 13, it is necessary to push the button 4 against the resiliency of the spring with an increased pushing force. Therefore, the operator has to exert a greater force in selecting a desired stitch pattern. This makes stitch pattern selection troublesome.

SUMMARY OF THE INVENTION

When a desired stitch pattern button is depressed, a corresponding pawl lock is held in a fixed position. Rotation of an upper driven shaft in a sewing machine causes a pawl support to be shifted into engagement with the pawl lock and to lock the latter in position. At the same time, opposite ends of a pawl pivotably mounted on the shifted pawl support are pressed against a stitch pattern cam and a pivot plate operatively connected to a needle-bar assembly of the sewing machine. With this arrangement, depression of the desired stitch pattern selector button only enables the corresponding pawl lock to be kept in position, and does not act on the stitch pattern cam and the pivot plate through the pawl support and the pawl.

It is an object of the present invention to provide a stitch pattern selector having stitch pattern selector buttons that can be depressed with a reduced force.

Another object of the present invention is to provide a stitch pattern selector having stitch pattern selector buttons depressable through short uniform strokes.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
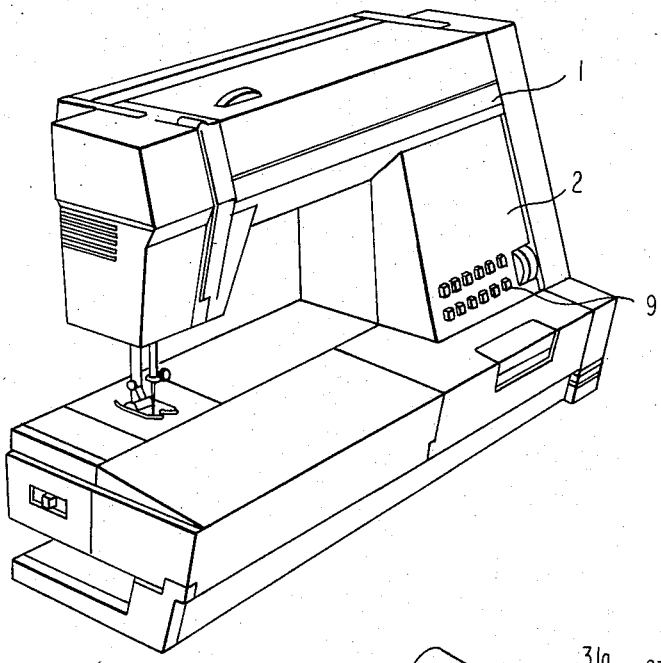
FIG. 1 is a perspective view of a sewing machine in which the principles of the present invention are incorporated.
Figure 2:
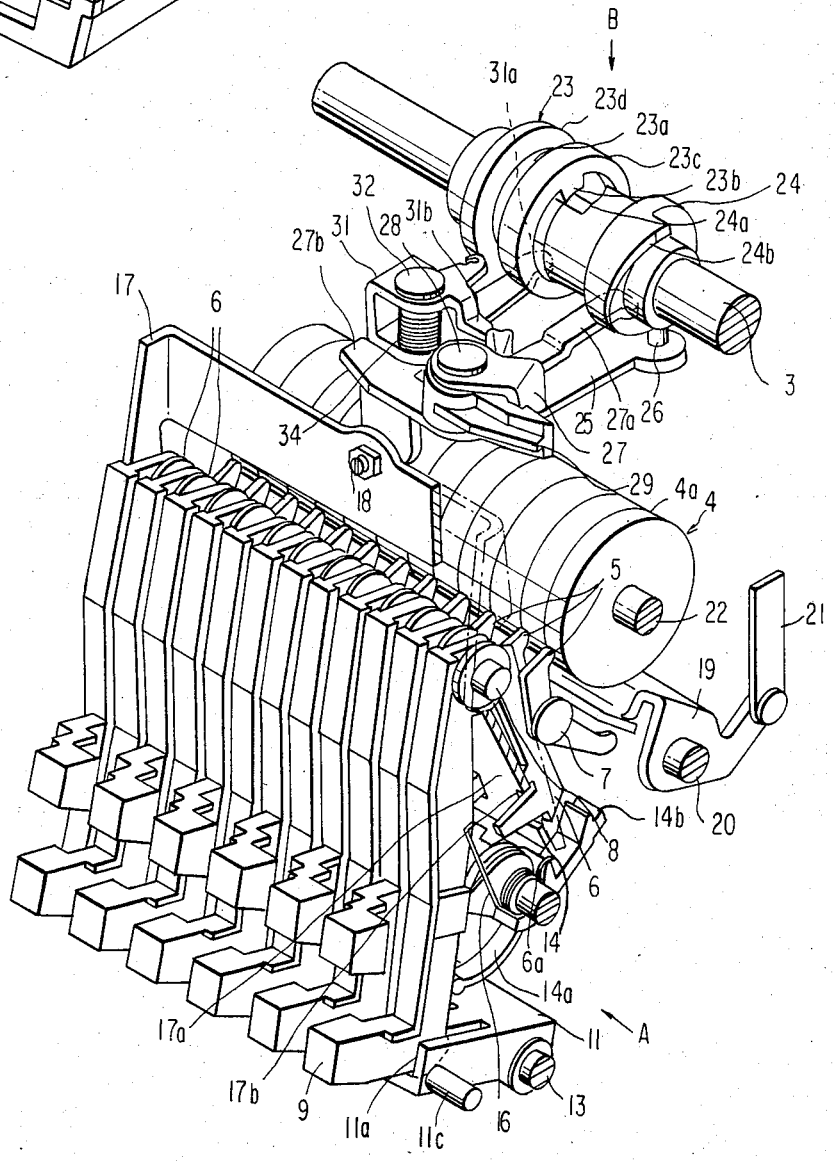
FIG. 2 is a perspective view of stitch pattern selector according to the present invention.
Figure 3:
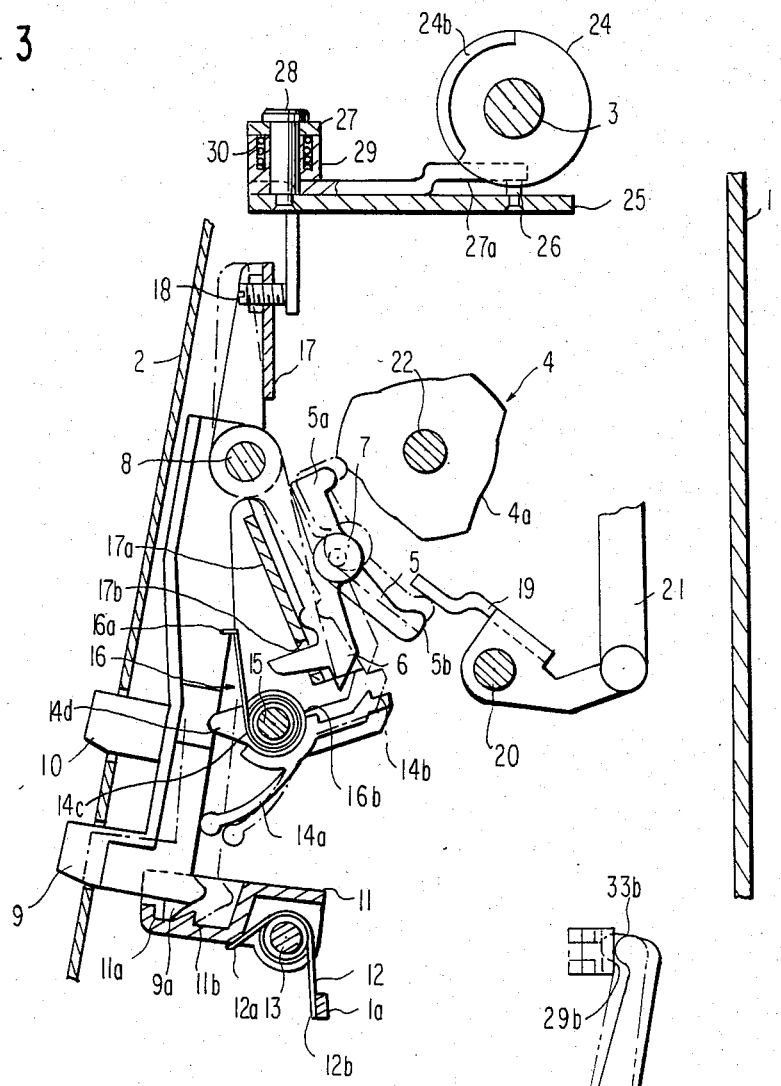
FIG. 3 is a side elevational view, partly in cross section, taken along line of A of FIG. 2.

As shown in FIG. 1, a sewing machine has an arm 1 including a front cover 2 through which a plurality of stitch pattern selector buttons 9 project in a double-tier pattern. As illustrated in FIG. 2, the total number of stitch pattern selector buttons 9 is equal to the total number of a group 4 of stitch pattern cams 4*a* rotatably supported on a cam shaft 22. The stitch pattern selector buttons 9 have upper arm portions pivotably mounted on a common pivot shaft 8 and lower triangular locking projections 9*a* as shown in FIG. 3.

A pawl lock shaft 15 is disposed below and extends parallel to the pivot shaft 8. As many pawl locks 14 as there are the stitch pattern selector buttons 9 are swingably mounted on the pawl lock shaft 14. Each pawl lock 14 is composed of a proximal hub 14*c* pivotably mounted on the pawl lock shaft 15, a resilient web 14*a* extending from the proximal hub 14*c* toward the button 9, and a pawl 14*b* extending from the proximal hub 14*c* in a direction away from the resilient web 14*a*. The proximal hub 14*c* includes a radial tongue 14*d* projecting into an aperture 9*d* defined in one of the stitch pattern selector buttons 9. The resilient web 14*a* is held in abutment against one of the stitch pattern selector buttons 9. A torsion spring 16 is mounted on the proximal hub 14*c* of each pawl lock 14 and has one end 16*a* engaging one stitch pattern selector button 9 and an opposite end 16*b* normally urging the resilient web 14*a* to turn counterclockwise as shown in FIG. 3 for thereby forcing the corresponding stitch pattern selector button 9 to project out of the front cover 2.

Below the pawl lock shaft 15, there is provided a limiter shaft 13 extending parallel to the pawl lock shaft 15 and supporting thereon a limiter 11 for pivotable movement thereof about the limiter shaft 13. The limiter 11 has a plurality of front parallel slots 11*a* and a plurality of rear parallel slots 11*d* with triangular ledges 11*b* positioned therebetween, the slots 11*a*, 11*d* being arranged at intervals along the length of the limiter 11. A torsion spring 12 is mounted on the limiter shaft 13 and has ends 12*a*, 12*b* engaging a bottom of the limiter 11 and a fixed portion 1*a* of the arm 1, respectively. The limiter 11 is thus normally biased to turn about the limiter shaft 13 in a clockwise direction as shown in FIG. 3. When each stitch pattern selector button 9 projects foward of the front cover 2, the triangular locking projecting 9*a* is located in the corresponding front slot 11*a* in the limiter 11. When the stitch pattern selector button 9 is depressed against the front cover 2, the triangular locking projection 9*a* rides over and across the triangular ledge 11*b* into the rear slot 11*d*.

Figure 4:
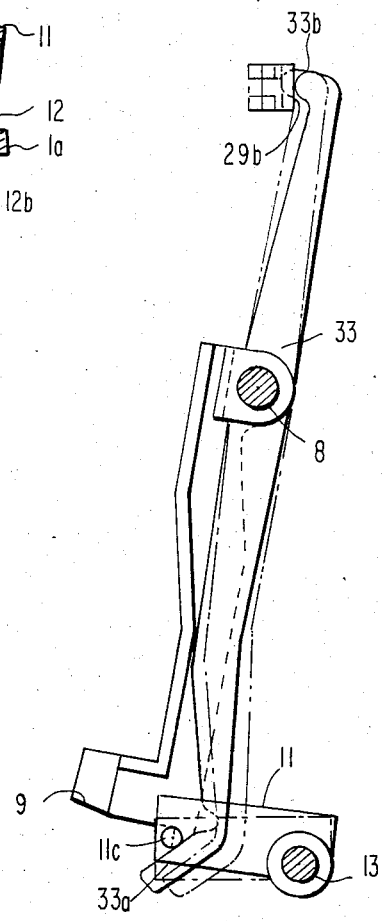
FIG. 4 is a view showing a release lever and a stitch pattern selector button which coact with each other.

As shown in FIG. 2, the limiter 11 has a pin 11*c* projecting at a longitudinal end thereof and engaging an arm 33*a* at a lower end of a release lever 33, as shown in FIG. 4. The release lever 33 is pivotably mounted on the pivot shaft 8. When the triangular locking projection 9*a* of the stitch pattern selector button 9 rides over and across the triangular ledge 11*b* of the limiter 11, the latter is angularly moved counterclockwise (FIG. 4) about the limiter shaft 13. Such counterclockwise angular movement of the limiter 11 causes the release bar 33 to turn counterclockwise about the pivot shaft 8, whereupon a pawl 33*b* at an upper end of the release lever 33 is brought into engagement with an arm 29*b* of a clutch release latch 29 (FIGS. 2 and 3).

Figure 5:
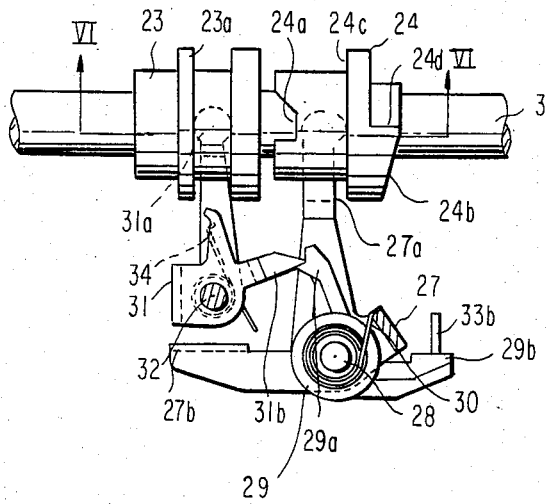
FIG. 5 is a plan view, partly in cross section, taken along line B of FIG. 2.

As illustrated in FIGS. 2 and 3, a pattern switching arm shaft 28 is mounted vertically on a bracket 25 fixed to the arm 1. The clutch release latch 29 is pivotably supported on the pattern switching arm shaft 28 and normally urged by a spring 30 (FIG. 5) to turn counterclockwise. A pattern switch arm 27 is also pivotably mounted on the pattern switching arm shaft 28 and normally urged by the spring 30 to turn clockwise as shown in FIG. 5.

Figure 6:
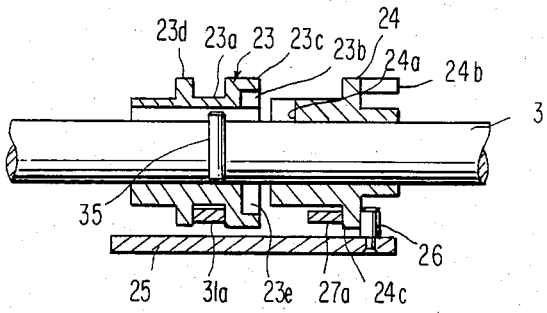
FIG. 6 is a cross-sectional view taken along line VI—VI of FIG. 5.

A stitch pattern switching cam 24 is rotatably mounted on a horizontal upper drive shaft 3. The stitch pattern switching cam 24 has a flange 24*c* (FIGS. 5 and 6) including an inclined cam surface 24*b* on a righthand end surface thereof, the cam surface 24*b* terminating in an edge 24*d*. The stitch pattern switching cam 24 also has a recess 24*a* in a lefthand end surface thereof. The flange 24*c* of the stitch pattern switching cam 24 is sandwiched between a distal end portion 27*a* of the stitch pattern switching arm 27 and a pin 26 mounted on the bracket 25 below the upper shaft 3.

A selector clutch 23 is mounted on the upper shaft 3 and movable axially therealong, but prevented from turning about the upper shaft 3 by a pin 35 extending diametrically through the upper shaft 3. The selector clutch 23 has a pair of flanges 23*c*, 23*d* spaced axially from each other with a circumferential groove 23*a* defined therebetween. The flange 23*c* has therein an arcuate groove 23*e* and a radially inward projection 23*b*.

A clutch moving arm 31 is pivotably mounted on the bracket 25 by a shaft 32. The clutch moving arm 31 has an engagement portion 31*a* fitted in the circumferential groove 23*a* in the selector clutch 23 and a pawl 31*b* positioned for engagment with an arm 29*b* of the clutch release latch 29. The clutch moving arm 31 is normally urged to turn clockwise as shown in FIG. 5 under the resiliency of a spring 34 mounted on the shaft 32.

As illustrated in FIGS. 2 and 3, a stitch pattern selector arm 17 is pivotably mounted on the pivot shaft 8 and includes an integral pattern selector plate 17*a* having as many holes 17*b*as there are the stitch pattern selector buttons 9. A plurality of pawl supports 6 are pivotably mounted on the pivot shaft 8 and have fingers 6*a* fitted respectively in the holes 17*b*. The switch pattern selector arm 17 has a central screw 18 threaded therethrough and held in abutment against a bent portion 27*b* extending downwardly from the stitch pattern switching arm 27. The switch pattern selector arm 17 can be angularly moved counterclockwise as shown in FIG. 3 by the action of the bent portion 27*b*.

A plurality of pawls 5 are pivotably mounted respectively on the pawl supports 6 by pins 7. Each pawl 5 has ends 5*a*, 5*b* facing the corresponding cam 4*a* and a pivot plate 19. When the pawl support 6 is turned counterclockwise as illustrated in FIG. 3, the ends 5*a*, 5*b* of the pawl 5 are brought into abutment against the cam 4*a* and the pivot plate 19, respectively.

The pivot plate 19 is pivotably supported on a support shaft 20 and coupled with a rod 21. The pivot plate 19 and the rod 20 serve to transmit swinging motions of the pawls 5 to a needle-bar mechanism (not shown).

Operation of the foregoing construction is as follows:

When a desired stitch pattern selector button 9 is depressed, the triangular locking projection 9*a* thereof moves from the corresponding front slot 11*a* over and past the triangular ledge 11*b* of the limiter 11 into the rear slot 11*d*. The locking projection 9*a* is then locked in the rear slot 11*d* under the bias of the spring 12. At the same time, the pawl lock 14 engaging the depressed button 9 is turned counterclockwise into a position shown by the imaginary line in FIG. 3. When the locking projection 9*a* rides over and across the triangular ledge 11*b* of the limiter 11, the limiter 11 is turned downwardly counterclockwise as illustrated in FIG. 3. The pin 11*c* on the limiter 11 then causes the release lever 33 to turn counterclockwise as shown in FIG. 4, whereupon the pawl 33*b* on the release lever 33 pushes the arm 29*b* of the clutch release latch 29. The clutch release latch 29 is then angularly moved clockwise as shown in FIG. 5 to enable the pawl 29*a* to disengage from the pawl 31*b*. The clutch moving arm 31 is allowed to turn clockwise as shown in FIG. 5 under the force of the spring 34, moving the selector clutch 23 to the right into abutment against the stitch pattern switching cam 24. The pawl 31*b* is positioned below the pawl 29*a* of the release latch 29 as shown in FIG. 5.

When the sewing machine is put into operation at this time, the upper shaft 3 is rotated about its own axis to rotate selector clutch 23 therewith. While the latter makes one revolution, the projection 23*b* thereof fits into the recess 24*a* in the stitch pattern switching cam 24, to thereby allow the selector clutch 23 and the stitch pattern switching cam 24 to rotate in unison. The cam surface 24*b* of the cam 24 is then pressed against the pin 26, whereupon the cam 24 and the selector clutch 23 are shifted to the left as shown in FIG. 5 while rotating together. The distal end portion 27*a* of the stitch pattern switching arm 27 is caused by the flange 24*c* of the cam 24 to turn counterclockwise as shown in FIG. 5. The bent portion 27*b* of the stitch pattern switching arm 27, which turns counterclockwise in FIG. 5, pushes the screw 18 to turn the stitch pattern selector arm 17 counterclockwise as shown in FIG. 3. Then, the stitch pattern selector plate 17*a* causes all of the pawl supports 6 to turn counterclockwise in FIG. 3. One of the pawl supports 6 which corresponds to the depressed stitch pattern selector button 9 moves past and is engaged and locked by the pawl 14*b* of the corresponding pawl 14 which has been displaced to the imaginary position. The ends 5*a*, 5*b* of the pawl 5 corresponding to the depressed stitch pattern selector button 9 are pressed against the corresponding cam 4*a* and the pivot plate 19, respectively.

While the stitch pattern selector operates in this manner after the sewing machine has been actuated, the cam surface 24*b* of the cam 24 approaches its highest point against the pin 26. During this time, the engagement portion 31*a* of the clutch moving arm 31 is turned counterclockwise as shown in FIG. 5. The pawl 31*b* of the clutch moving arm 31 is also angularly moved counterclockwise until it displaces the release latch 29 clockwise and engages the pawl 29*a* thereof. When the pin 26 falls off the highest point of the cam surface 24*b* across the edge 23*d*, the stitch pattern switching arm 27 is turned clockwise as shown in FIG. 5 under the resiliency of the spring 30 to move the stich pattern switching cam 24 to the right out of contact with the selector clutch 23. Simultaneously, the stitch pattern switching arm 27 returns to its original position to allow all of the pawl supports 6 except one corresponding to the depressed button 9 to their original position. The foregoing series of operations is all effected while the upper shaft 3 makes two revolutions about its own axis. Thereafter, the sewing machine carries out a known sewing operation for the selected stitch pattern.

When a next desired stitch pattern selector button 9 is depressed, the limiter 11 is turned to release the button 9 previously depressed and locked by the limiter 11. The pawl support 6 corresponding to the previously selected button 6 remains actuated due to frictional resistance acting between the distal end of the pawl support 6 and the pawl 14*b* of the pawl lock 14. However, the pawl support 6 will be released and returned to its original position when the stitch pattern selector goes through a series of operations to select a next desired stitch pattern.

Although a certain preferred embodiment has been shown and described, it should be understood that many changes and modifications may be made therein without departing from the scope of the appended claims.

What is claimed is:

1. A stitch pattern selector in a sewing machine, comprising:

(a) a plurality of depressable stitch pattern selector buttons;

(b) a plurality of pawl locks actuatable respectively by said stitch pattern selector buttons to move to a locking position in response to the latter's being depressed;

(c) a plurality of drivable stitch pattern cams;

(d) a pivotable plate operatively connected to a needle-bar assembly of the sewing machine;

(e) a plurality of pivotably movable pawl supports;

(f) a plurality of pawls swingably mounted respectively on said pivotable pawl supports and movable with said pivotably movable pawl supports into a first position in which said pawls are pressed against said stitch pattern cams and said pivotable plate and a second position in which said pawls are disengaged from said stitch pattern cams and said pivotable plate;

(g) a drive shaft;

(h) means operatively connected to said pawl supports and operable for moving all of said pawls to said first position;

(i) a clutch mechanism operatively connected between said drive shaft and said means and actuatable in response to depression of one of said stitch pattern selector buttons and rotation of said drive shaft for operating said means to move said pawls to said first position, said clutch mechanism being disconnectable in response to continued rotation of said drive shaft for allowing said means to return said pawls except one corresponding to said one of the stitch pattern selector buttons to said second position, whereby one of said pawl supports supporting said one of the pawls can be locked by one of said pawl locks actuated into said locking position by said one of the stitch pattern selector buttons.

2. A stitch pattern selector according to claim 1, wherein said clutch mechanism comprises a cam rotatably mounted on said drive shaft, a fixed pin slidably engageable with said cam on rotation thereof, a selector clutch mounted on said drive shaft for corotation and movable axially on said drive shaft into corotating engagement with said cam, and link means responsive to depression of said one of the stitch pattern selector buttons for causing said selector clutch to move along said drive shaft into corotating engagement with said cam.

3. A stitch pattern selector according to claim 2, wherein said link means comprises a swingable limiter having a pin and swingable in response to depression of said one of the stitch pattern selector buttons, a pivotable lever angularly movable by said pin on swinging movement of said swingable limiter, a clutch release latch engageable by said pivotable lever, and a clutch moving arm normally biased for moving said selector clutch in a direction to engage said cam and normally latched by said clutch release latch to keep out of engagement with said cam, said clutch moving arm being unlatched by said clutch moving arm when the latter is engaged by said pivotable lever in response to the latter's being angularly moved.

4. A stitch pattern selector according to claim 3, wherein said cam comprises an inclined cam surface slidably engageable with said fixed pin and terminating in an axial edge, said means being operatively coupled to said cam and operable in response to axial movement of said selector clutch and said cam along said drive shaft on sliding movement of said inclined cam surface against said fixed pin when said selector clutch and said cam rotate with said drive shaft.

5. A stitch pattern selector according to claim 4, wherein said means comprses a first pivotable arm having one end operatively coupled to said cam, and a second pivotable arm operatively coupled to an opposite end of said first pivotable arm and engageable with said pawl supports.

* * * * *